US010414632B1

(12) United States Patent
Terry et al.

(10) Patent No.: US 10,414,632 B1
(45) Date of Patent: Sep. 17, 2019

(54) ESCALATOR SYSTEM FOR FACILITATING THE TRANSPORT OF GOODS

(71) Applicants: Constanza Terry, Miami Shores, FL (US); Amelie Terry, Miami Shores, FL (US)

(72) Inventors: Constanza Terry, Miami Shores, FL (US); Amelie Terry, Miami Shores, FL (US)

( * ) Notice: Subject to any disclaimer, the term of this patent is extended or adjusted under 35 U.S.C. 154(b) by 0 days.

(21) Appl. No.: 16/410,399

(22) Filed: May 13, 2019

(51) Int. Cl.

| | |
|---|---|
| ***B66B 23/12*** | (2006.01) |
| ***B66B 23/02*** | (2006.01) |
| ***B66B 25/00*** | (2006.01) |
| ***B66B 21/04*** | (2006.01) |
| ***B66B 23/24*** | (2006.01) |

(52) U.S. Cl.
CPC ..... *B66B 23/12* (2013.01); *B66B 21/04* (2013.01); *B66B 23/02* (2013.01); *B66B 23/24* (2013.01); *B66B 25/00* (2013.01)

(58) Field of Classification Search
CPC ..... B66B 23/02; B66B 23/12; B66B 25/00
USPC ..... 198/326, 333
See application file for complete search history.

(56) References Cited

U.S. PATENT DOCUMENTS 4,569,433 A * 2/1986 Ishida ..... B66B 31/006 198/326
4,726,463 A * 2/1988 Babler ..... B66B 23/12 198/333
5,295,569 A * 3/1994 Kubota ..... B66B 23/02 198/333
5,353,907 A * 10/1994 Ogimura ..... B66B 31/006 198/333
5,381,881 A * 1/1995 Meyer ..... B66B 31/006 198/333
5,386,904 A * 2/1995 Ojima ..... B66B 23/12 198/333
5,435,428 A * 7/1995 Adachi ..... B66B 31/006 198/324
5,992,605 A * 11/1999 Haruta ..... B66B 31/006 198/333
6,098,779 A * 8/2000 Kubota ..... B66B 31/006 198/333
9,457,995 B2 * 10/2016 Makovec ..... B66B 23/14
10,336,582 B2 * 7/2019 Gartner ..... B66B 25/006

* cited by examiner

*Primary Examiner* — Douglas A Hess
(74) *Attorney, Agent, or Firm* — Mark Terry

(57) ABSTRACT

An escalator system for facilitating the transport of good is disclosed. The system includes a step plate comprising a horizontal planar surface configured for supporting a passenger's weight. A pulley is located near, and coupled with, a bottom of the step plate. The system also includes a retracting platform having a horizontal planar surface coplanar with the horizontal planar surface of the step plate. The retracting platform is configured to lower into the step plate. A platform chain is connected on one end to an upper adjacent step plate and connected on another end to a bottom surface of the retracting platform. The platform chain extends around the pulley and when the upper adjacent step plate moves upward, the platform chain is pulled toward the upper adjacent step plate, and the platform chain pulls the retracting platform down such that the retracting platform lowers into the step plate.

7 Claims, 9 Drawing Sheets

ESCALATOR SYSTEM FOR FACILITATING THE TRANSPORT OF GOODS

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of escalators, and more specifically to a safety system structure of an escalator.

BACKGROUND

An escalator is a power-driven, continuous moving stairway designed to transport passengers up and down short vertical distances. The first operational escalator was patented in 1892 and installed on Coney Island, N.Y., as an amusement ride. The device, however, was destined to serve as a serious means of transport. In the United States, there are an estimated 35,000 escalators, each serving an average of 12,000 people per year. Collectively, U.S. escalators make 105 billion passenger trips per year. The vast majority of these escalators are located within commercial, retail, and public buildings such as airports and hospitals. Not surprisingly, incidents involving escalators kill about 30 and seriously injure about 17,000 people each year in the United States, according to data provided by the U.S. Bureau of Labor Statistics and the Consumer Product Safety Commission.

A potentially hazardous conflict exists in environments such as airports, train stations and high traffic intensity environments due to the presence of luggage or goods of some form. In some cases, falling luggage or goods may cause a passenger to fall causing a second passenger to fall and so on, leading to a human pile at the lower landing of the escalator. In fact, at Seattle Tacoma International Airport, people with luggage fall so frequently on escalators that state inspectors have repeatedly recommended that Seattle Tacoma International Airport add signs directing people away from escalators and toward elevators. However, adding signs can cause people to stop abruptly, creating additional traffic flow problems. In other cases, luggage or goods may get caught in the machinery or wedged against the side walls of the escalator, causing people to trip and fall.

Despite the increase in accidents and the possible severity of the resulting injuries, escalator manufacturers have failed to address the need for safer designs notwithstanding the fact that many of the escalators travelled by millions of people today are decades old. Therefore, a need exists for an escalator system that facilitates the transport of goods to reduce the probability and severity of escalator-related injuries and enhance the safety of passengers.

SUMMARY

An escalator system for facilitating the transport of goods is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an escalator system for facilitating the transport of goods is disclosed. The system includes a step plate comprising a horizontal planar surface configured for supporting a passenger's weight. A pulley is located near, and coupled with, a bottom of the step plate. The system also includes a retracting platform having a horizontal planar surface coplanar with the horizontal planar surface of the step plate. The retracting platform is configured to lower into the step plate. A platform chain is connected on one end to an upper adjacent step plate and connected on another end to a bottom surface of the retracting platform. The platform chain extends around the pulley and when the upper adjacent step plate moves upward, the platform chain is pulled toward the upper adjacent step plate, and the platform chain pulls the retracting platform down such that the retracting platform lowers into the step plate.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
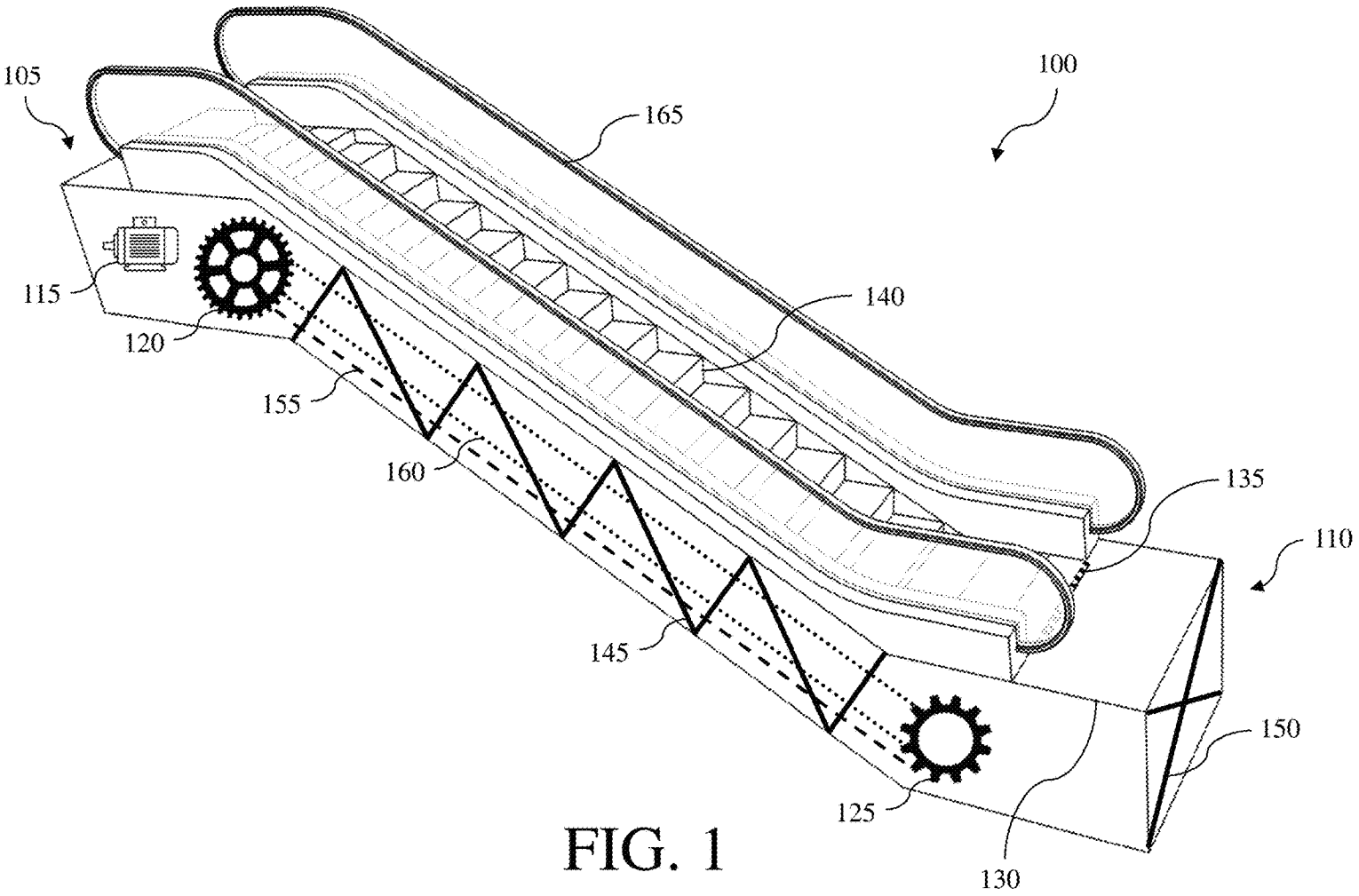
FIG. 1 is an illustration of a conventional escalator system with which the present invention is employed.
Figure 2:
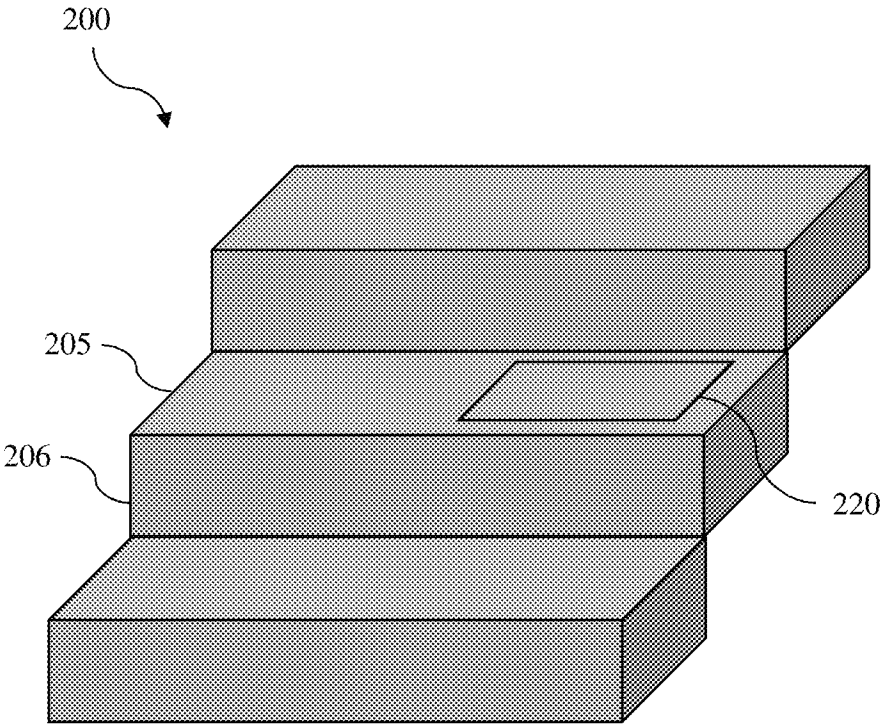
FIG. 2 is a front perspective view of an escalator system for facilitating the transport of goods, wherein the retracting platform surface is in line with the step plate surface, according to an example embodiment of the present invention.
Figure 3:
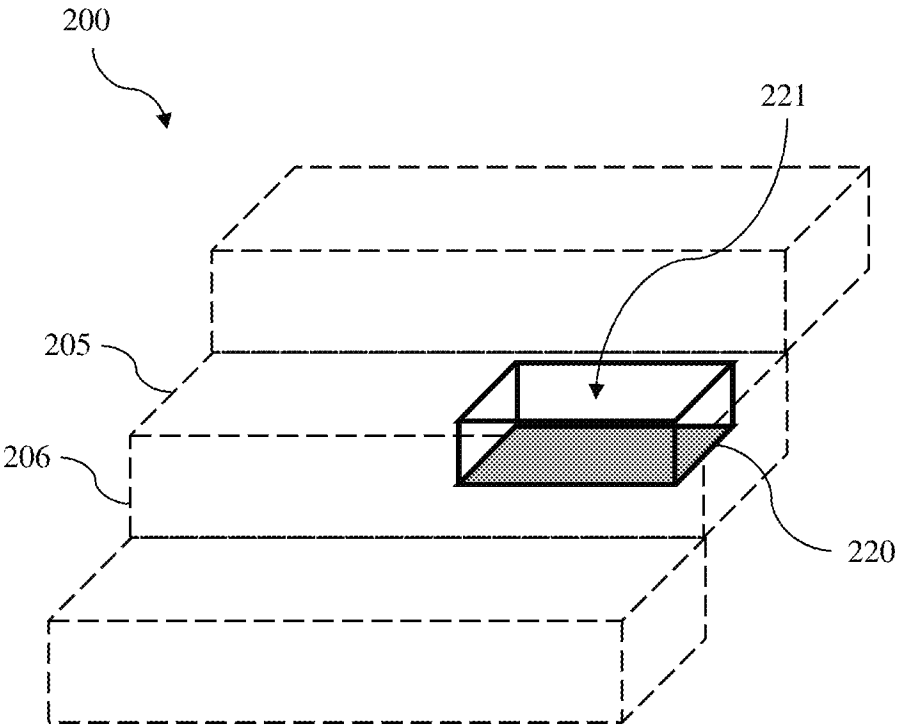
FIG. 3 is a front perspective sectional view of an escalator system for facilitating the transport of goods, wherein the retracting platform is lowered into the step plate, according to an example embodiment of the present invention.
Figure 4:
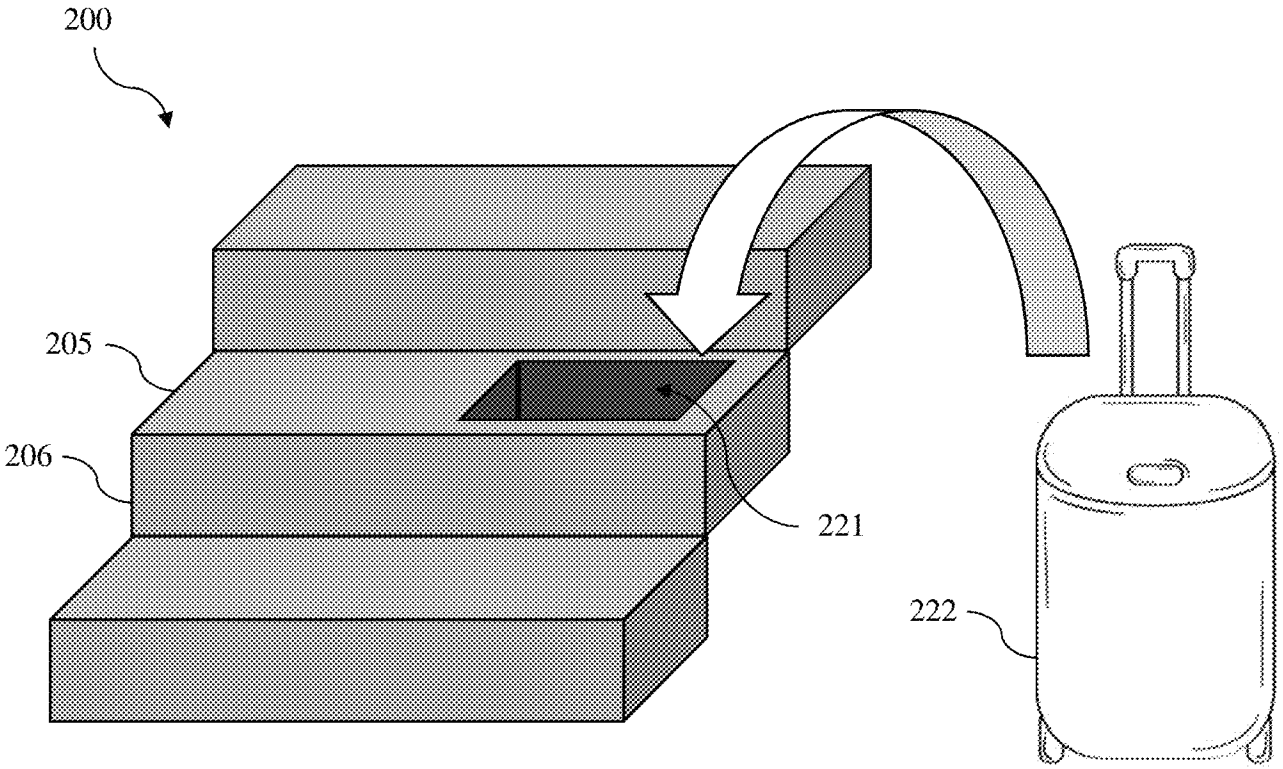
FIG. 4 is a front perspective view of an escalator system for facilitating the transport of goods, wherein the retracting platform is lowered into the step plate, according to an example embodiment of the present invention.
Figure 5:
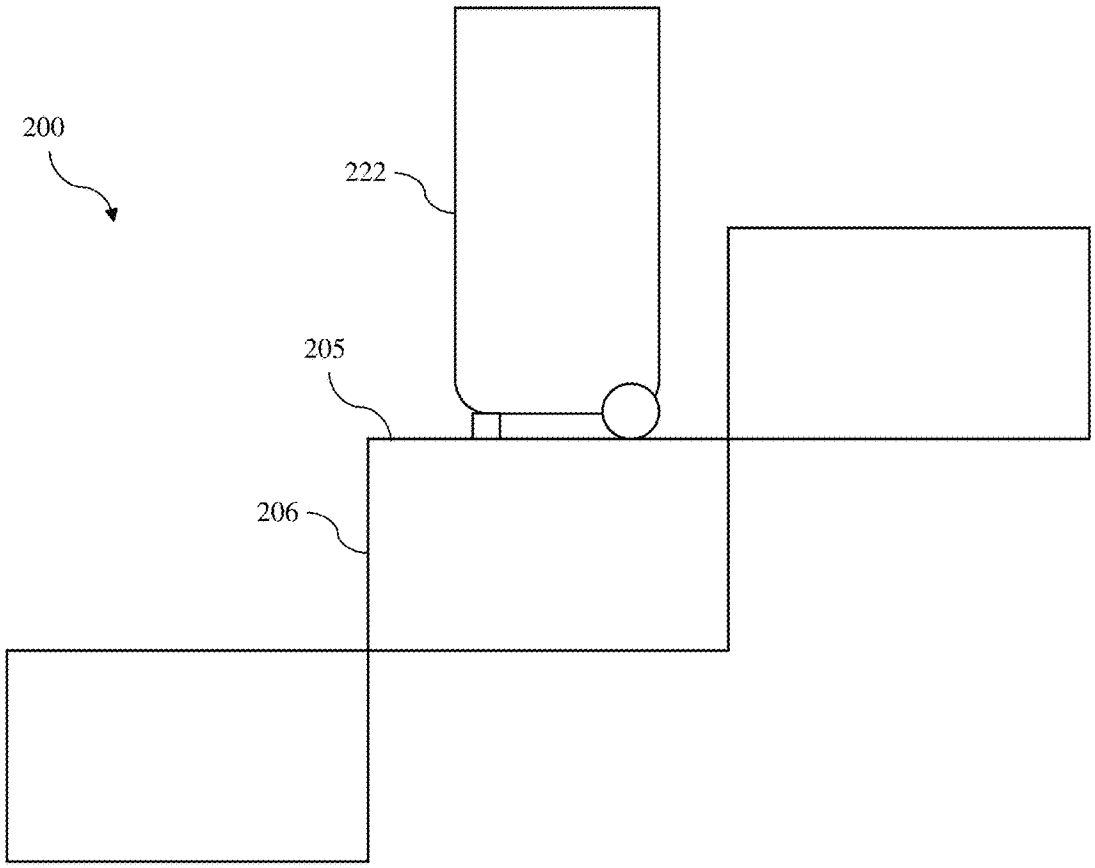
FIG. 5 is a left side view of an escalator system for facilitating the transport of goods, wherein the retracting platform surface is in line with the step plate surface, according to an example embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The present invention improves upon the prior art in that it incorporates a retracting platform that is configured to lower into a step plate to facilitate the transport of goods, reduce the probability and severity of escalator-related injuries, and enhance the safety of passengers.

Referring now to the Figures, FIG. 1 is an illustration of a conventional escalator system 100 with which the present invention is employed. As shown in FIG. 1, the escalator includes a top landing platform 105 and a bottom landing platform 110. The top landing platform contains a motor 115 and a main drive gear 120. The bottom landing platform contains a step return idler sprocket 125. The top landing platform and the bottom landing platform each contain a floor plate 130 and a comb plate 135. The floor plate provides a place for passengers to stand before they step onto the moving stairs. The floor plate is flush with the finished floor and is either hinged or removable to allow easy access to the machinery below. The comb plate is located between a plurality of moving steps 140 and the floor plate. The comb plate is configured to prevents fingers, feet or foreign objects from getting caught between the floor plate and the moving step. A truss 145 bridges the top landing platform and the bottom landing platform. The truss is the main supporting structure of the escalator, composed of two side sections joined together with cross braces 150 across the bottom and top of the structure. The ends of the truss are attached to the top landing platform and the bottom landing platform via steel or concrete supports. A track system 155 is built into the truss to guide a step chain 160. The step chain continuously pulls the steps from the bottom landing platform and back to the top landing platform in an endless loop. Additionally, a handrail 165 is included to provide a convenient handhold for escalator passengers.

FIGS. 2-6 illustrate an escalator system for facilitating the transport of goods, according to an example embodiment of the present invention. The system 200 includes a step plate 205 comprising a horizontal planar surface configured for supporting a passenger's weight. The step plate also includes a generally vertical front riser portion 206. Each step plate executes a relative movement to the adjacent step plates in a vertical direction, particularly in the transition from the inclined escalator section to the horizontal escalator section. The step structure of the escalator is in that case transferred into a planar structure or band structure. The height difference between two adjacent step plates then changes continuously from the maximum value to zero. The step plate may be comprised of die-cast aluminum and feature narrow grooves for passenger comfort and safety. Additional, the step plate may include narrow pitch treads help prevent objects from being entangled at the comb plate, and provide a more stable platform on which to stand.

Figure 6:
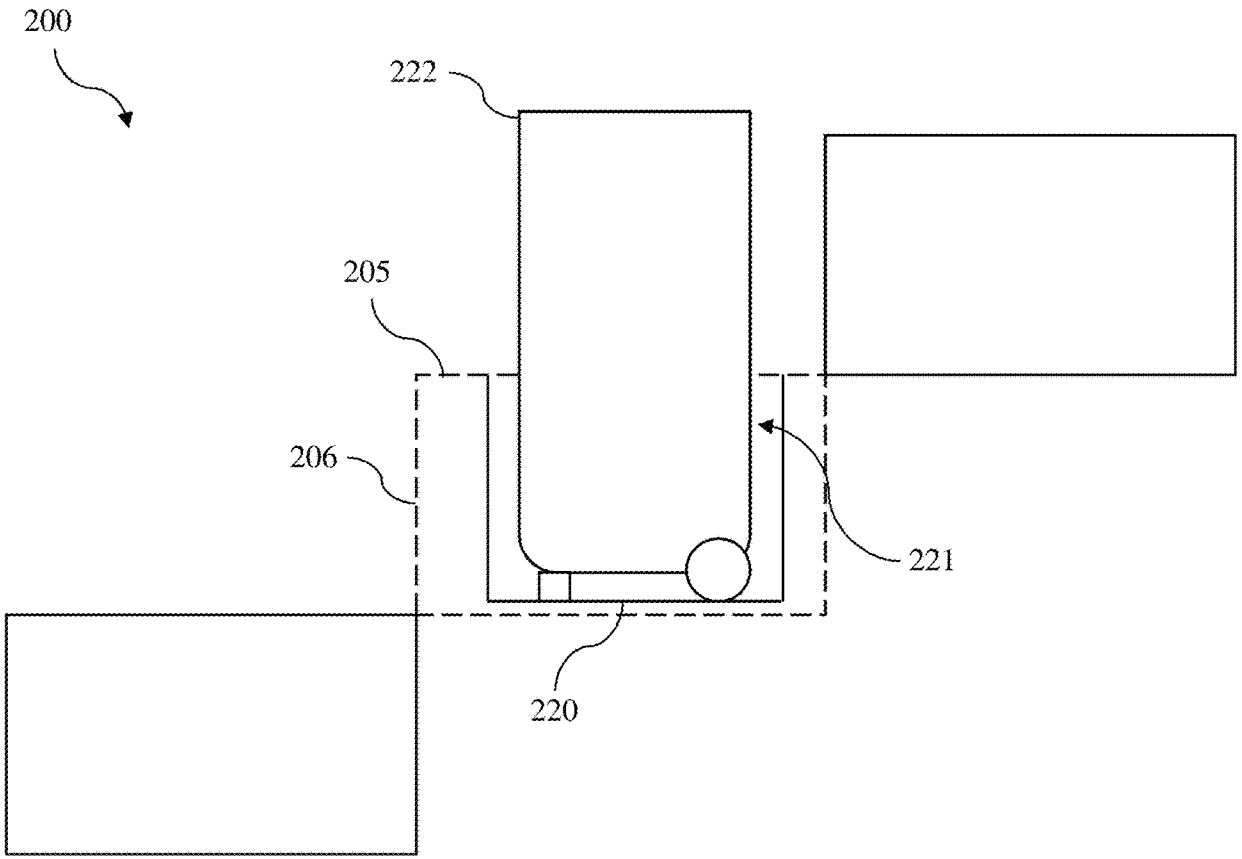
FIG. 6 is a left side view of an escalator system for facilitating the transport of goods, wherein the retracting platform is lowered into the step plate, according to an example embodiment of the present invention.

The system also includes a retracting platform 220 having a horizontal planar surface coplanar with the horizontal planar surface of the step plate. As best shown in FIG. 6, the retracting platform is configured to lower into the step plate for providing a storage space 221 to temporarily stow items such as luggage 222 or goods of some form to minimize the chance of accidents or injuries, as described more fully below. In one embodiment, the retracting platform 220 may be painted a different color from the step plate 205 or may be painted with a figure or graphic of a piece of luggage, in order to visually indicate to the user that luggage is placed on the retracting platform, and to visually indicate to the user that the retracting platform is not for use for standing by the user.

Figure 7:
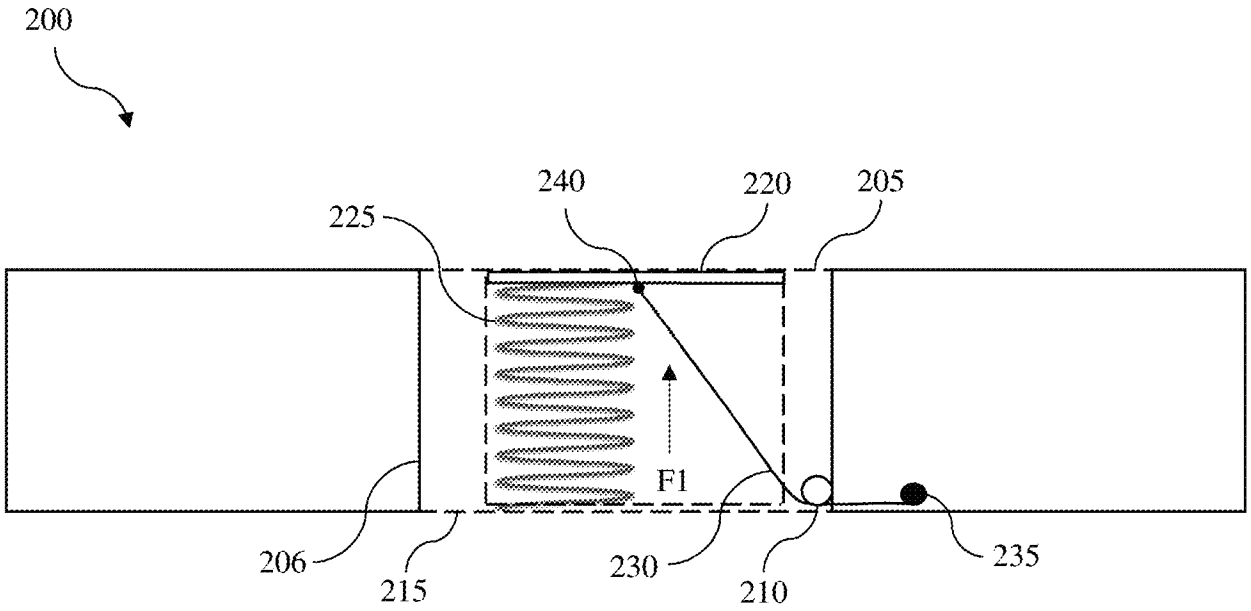
FIG. 7 is a left side view of an escalator system for facilitating the transport of goods, wherein the spring is applying a compressive force against the retracting platform to maintain the retracting platform surface in line with the step plate surface, according to an example embodiment of the present invention.
Figure 8:
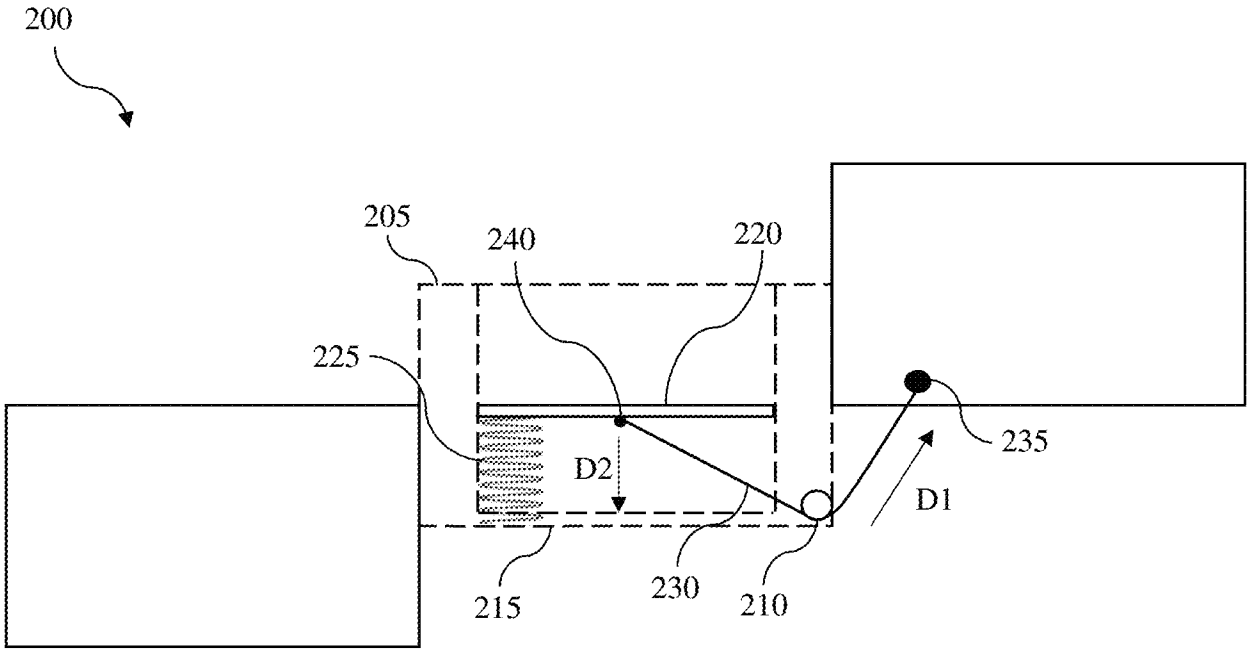
FIG. 8 is a left side view of an escalator system for facilitating the transport of goods, wherein the upper adjacent step plate is moving upward, and the platform chain is being pulled toward the upper adjacent step plate, according to an example embodiment of the present invention.
Figure 9:
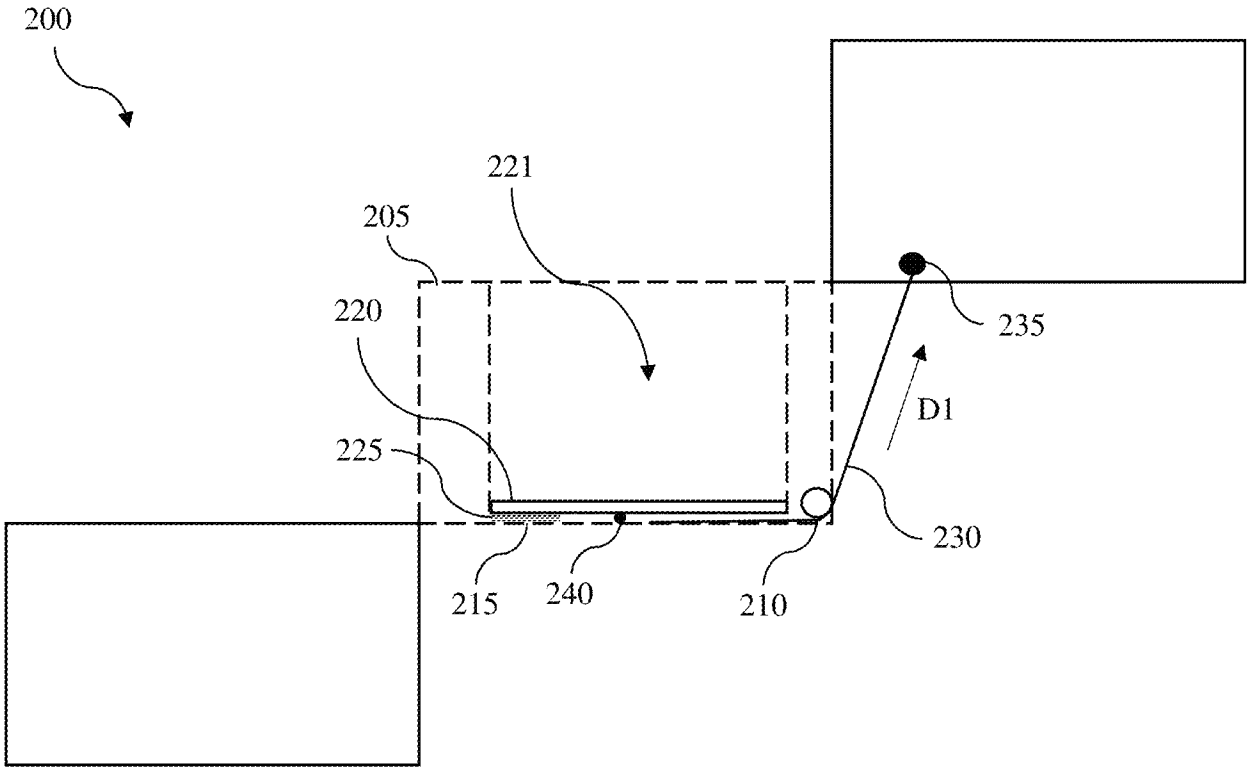
FIG. 9 is a left side view of an escalator system for facilitating the transport of goods, wherein the platform chain is pulling the retracting platform down such that the retracting platform lowers into the step plate, according to an example embodiment of the present invention.

FIGS. 7-9 illustrate the movement of the retracting platform, according to an example embodiment of the present invention. A pulley 210 is located near, and coupled with, a bottom 215 of the step plate. At least one spring 225 is located beneath the retracting platform and anchored to the bottom of the step plate. The spring is configured to apply a compressive force (in the direction of line Fl) against the retracting platform to maintain the retracting platform surface in line with the step plate surface. A platform chain 230 is connected on one end to an upper adjacent 235 step plate and connected on another end to a bottom surface 240 of the retracting platform. The platform chain extends around the pulley and when the upper adjacent step plate moves upward, the platform chain is pulled toward the upper adjacent step plate (in the direction of line D1), and the platform chain pulls the retracting platform down (in the direction of line D2) such that the retracting platform lowers into the step plate.

A track (not shown) is configured for guiding the platform chain from a bottom landing platform to a top landing platform in an endless loop. The track is spaced apart in such a way that the step plate and the retracting platform will always remain level. At the top and bottom of the escalator, the tracks level off to a horizontal position, flattening the stairway. The system further comprises a handrail (not shown) movable along a length of the system. The handrail provides a handhold for passengers while they are riding the escalator. The handrail is pulled along its own track by a chain that is connected to the main drive gear by a series of pulleys, keeping it at the same speed as the steps.

A motor is conductively and communicatively coupled with a power source for driving the system. The motor turns the main drive gear, which rotates the step chain and the platform chain. The power source may comprise a commercial power source capable of providing AC electric power of constant voltage and constant frequency. The system further comprises a control panel configured for controlling the operation and direction of escalator travel. The control panel is typically located either at the bottom or top of the escalator under the handrail.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. An escalator system for facilitating the transport of goods, wherein the system comprises:

a step plate comprising a horizontal planar surface configured for supporting a passenger's weight;

a pulley located near, and coupled with, a bottom of the step plate;

a retracting platform having a horizontal planar surface coplanar with the horizontal planar surface of the step plate, wherein the retracting platform is configured to lower into the step plate;

a platform chain connected on one end to an upper adjacent step plate, and connected on another end to a bottom surface of the retracting platform, wherein the platform chain extends around the pulley; and wherein when the upper adjacent step plate moves upward, the platform chain is pulled toward the upper adjacent step plate, and the platform chain pulls the retracting platform down such that the retracting platform lowers into the step plate.

2. The system of claim 1, wherein the system further comprises at least one spring located beneath the retracting platform, and anchored to the bottom of the step plate, wherein the spring applies a compressive force against the retracting platform to maintain the retracting platform surface in line with the step plate surface.

3. The system of claim 1, wherein the system further comprises a track for guiding the platform chain from a bottom landing platform to a top landing platform in an endless loop.

4. The system of claim 1, wherein the system further comprises a motor conductively and communicatively coupled with a power source for driving the system.

5. The system of claim 1, wherein the system further comprises a handrail movable along a length of the system.

6. The system of claim 1, wherein the system further comprises a control panel configured for controlling the operation and direction of escalator travel.

7. The system of claim 1, wherein the retracting platform is painted a different color from a color of the step plate.

* * * * *